US006139379A

United States Patent [19]

Jamieson

[11] Patent Number: 6,139,379

[45] Date of Patent: Oct. 31, 2000

[54] JET PROPELLED WATERCRAFT AND A SIMPLIFIED LOW COST DRIVE THEREFOR

[76] Inventor: John R. Jamieson, 416 Lark Pl., Enchanted Oaks, Tex. 75147

[21] Appl. No.: 09/391,080

[22] Filed: Sep. 4, 1999

[51] Int. Cl.[7] ..... B63H 11/00

[52] U.S. Cl. ..... 440/38; 440/47

[58] Field of Search ..... 440/38, 47, 83; 60/221

[56] References Cited

U.S. PATENT DOCUMENTS

| | | | |
|---|---|---|---|
| 3,790,312 | 2/1974 | Bottoms | 417/424.1 |
| 4,417,877 | 11/1983 | Krautkremer et al. | 440/38 |
| 4,790,781 | 12/1988 | Takahashi | 440/38 |
| 4,826,398 | 5/1989 | Gullichsen | 415/143 |
| 5,289,793 | 3/1994 | Aker | 440/38 |
| 5,988,600 | 11/1999 | Vento | 261/29 |

*Primary Examiner*—Stephen Avila
*Attorney, Agent, or Firm*—Marshall A. Burmeister

[57] ABSTRACT

An engine and pump assembly in which the pump has a water impermeable housing with a hollow cylindrical sleeve open at one end, and a plate mounted and sealed on the other end of the sleeve. The plate has an aperture disposed on the axis of the sleeve; and an engine is mounted on the housing with a drive shaft extending through the aperture in the plate coaxially with the sleeve. The sleeve has a port extending therethrough, and an elongated water impermeable hollow tube extends outwardly from the port to an open opposing end. A first impeller is mounted on the shaft of the engine within the sleeve for transporting water from the open end of the sleeve toward the plate of the housing; and a second impeller is mounted on the shaft of the engine adjacent to the plate of the housing for directing the flow of water away from the aperture in the plate to counter the axial thrust on the engine shaft produced by the first impeller and to reduce or eliminate the pressure of the water in the sleeve on the engine shaft seal. In a preferred embodiment of the invention, a four-cycle engine and pump assembly is mounted on the bottom of a boat adjacent to the transom thereof with the open end of the sleeve confronting an opening in the bottom of the boat. The water impermeable tube extends through the transom of the boat to deliver a jet of water from the stem of the boat. A tiller assembly is mounted on the boat at the transom and attached to the tube to control the direction of the jet of water.

14 Claims, 3 Drawing Sheets

JET PROPELLED WATERCRAFT AND A SIMPLIFIED LOW COST DRIVE THEREFOR

BACKGROUND

The present invention relates to a simplified low cost jet pump, and to a jet propelled watercraft utilizing said pump.

Some sports and occupations, such as fishing, require a boat that is highly maneuverable and capable of use in shallow waters and the like. Jet powered boats are considered to be generally superior to propeller driven boats for such service, but the complexity and cost of conventional jet drives for jet propelled boats have limited use of such watercraft.

In general, conventional jet propulsion systems for small watercraft require an opening in the bottom of the craft which serves as a water intake, a pump for pressurizing the water entering through the intake opening, and a discharge tube extending from the pump through the stern wall or transom of the watercraft. The water passes from the discharge tube as a jet and exerts force on the jet propulsion system to drive the watercraft through the water. A typical watercraft of this type is described in U.S. Pat. No. 3,426,724 of Jacobson entitled Power Driven Aquatic Vehicle.

Jet propulsion of boats is inherently less efficient than propeller driven boats, and as a result has been limited in use to small personal watercraft, such as described in U.S. Pat. No. 3,426,724, or relatively large pleasure craft, both of which are relatively expensive. Further, neither small personal watercraft nor large pleasure craft is desirable for those sports and occupations requiring highly maneuverable boats and boats capable of use in shallow waters.

One of the reasons for the high cost of such watercraft is the cost of marine engines to drive the watercraft. In addition, marine engines are expensive to maintain. A major reason that marine engines are costly is low production. Since relatively few marine engines are produced, the cost of design and parts remains significantly higher than those of general utility engines, such as those used for lawn mowers, water pumps, rail splitters, and the like.

Another reason for the high cost of marine engines is the hostile environment in which they operate. Not only must such engines operate in a moist environment, but they are cooled by water drawn from the body of water upon which they operate, and this water may contain plant matter and/or minerals that adhere to the surfaces of the cooling system and make maintenance costly. Further, the use of external water for cooling requires the engine to employ special materials in its cooling system.

Most marine engines used for small watercraft are two-cycle engines that are inherently smaller, lighter and less costly to construct than four-cycle engines, and therefore particularly adapted for low production requirements. Two-cycle engines, however, are less efficient than four-cycle engines. Further, two-cycle engines develop their horse power at higher revolution rates than four-cycle engines, and therefore tend to be noisier. Two-cycle engines are also less convenient to use than four-cycle engines, since they require oil to be mixed with the fuel for the engine. Further, the use of two-cycle engines creates more pollution of the environment than use of four-cycle engines because vapors from the oil in the fuel are expelled into the atmosphere or water. Environmental considerations have caused the boating industry to consider the use of four-cycle engines rather than two-cycle engines even for small personal watercraft and has resulted in special marine four-cycle engines, such as described in U.S. Pat. No. 5,846,102 entitled FOUR-CYCLE ENGINE FOR A SMALL JET BOAT.

It is a general object of the present invention to provide a highly maneuverable boat that preferably is capable of use in shallow waters. It is a farther object of the present invention to provide such a boat at a significantly reduced cost from that of conventional constructions. More specifically it is an object of the present invention to provide a jet propelled boat that utilizes an air cooled four-cycle engine, and which may be constructed at a significantly lower cost than conventional comparable boats.

It is a further object of the present invention to provide a jet pump and engine assembly with the rotating member of the pump directly mounted on the drive shaft of the engine, thereby eliminating the mechanical coupling devices, bearings, support structure and seals which are generally used between the engine drive shaft and the rotating member of the pump. In the inventor's preferred construction, the drive shaft seal of the engine confronts the rotor of the pump, and the pump uses an impeller mounted on the rotor and disposed within a chamber to drive the liquid toward the engine seal, thereby pressurizing the liquid within the chamber and, in the absence of a remedial device, subjecting the seal to operating conditions that tend to damage the engine seal. It is a further object of the present invention to provide an assembly of an engine and a pump in which the pump has an impeller disposed within a chamber and directly mounted on the drive shaft of the engine, the impeller driving liquid toward the drive shaft seal of the engine, and the pump being provided with means to reduce or eliminate the pressure of the liquid being operated upon at the drive shaft seal.

Directly mounting a rotor of a pump on the drive shaft of an engine has the potential disadvantage of placing a force on the drive shaft that is directed along the axis of the drive shaft. Since in the preferred embodiment, the rotor has an impeller that transports liquid towards the bearing on the engine drive shaft, the drive shaft must provide the counter force to retain the drive shaft in position within the engine. It is a further object of the present invention to provide means associated with the rotor of the pump for reducing or eliminating the force on the drive shaft that is produced by the impeller.

SUMMARY OF THE INVENTION

The inventor has found that an extremely cost efficient hydraulic pump and engine assembly is provided utilizing a high production, four-cycle, air-cooled utility engine, such as is used to power lawn mowers, garden tractors, cultivators, rail splitters, and the like, in combination with a novel jet pump. In a preferred construction of the invention, an air-cooled, four-cycle engine with a vertical drive shaft is mounted over a housing of a jet pump, the housing having a cylindrical sleeve with an open end and a closed end. The drive shaft of the engine extends coaxially into the sleeve of the housing through an aperture in the closed end of the sleeve. The sleeve is provided with a port between the ends thereof, and a first or axial flow impeller is mounted on the drive shaft of the engine between the open end of the sleeve and the port to transport liquid toward the closed end of the sleeve. A second impeller is mounted on the drive shaft of the engine adjacent to the closed end of the sleeve to seal-off the water path to the aperture in the closed end of the sleeve. By the action of the first impeller, the liquid becomes pressurized within the sleeve, and is driven out of the sleeve through the port. In the preferred construction, the second impeller is a centrifugal flow impeller which substantially cancels or offsets the axial torque of the axial flow impeller on the drive shaft and the liquid pressure on the engine drive shaft seal.

A preferred use for the hydraulic pump described above is to power a boat for recreational purposes and commercial fishing. Generally, a boat has a bow, a stem wall or transom, a bottom extending between the bow and the transom, and sides extending from the bottom between the bow and the transom. In accordance with this invention, the engine and pump assembly described above is mounted on the bottom of the boat adjacent to the transom, and an opening is provided in the bottom of the boat confronting the open end of the sleeve of the pump. The housing of the pump is sealed about the perimeter of the opening in the bottom of the boat to prevent water from leaking into the boat. A hollow tube has one end mounted on the sleeve of the housing in communication with the port in the sleeve, and the tube extends through an aperture in the transom to deliver a jet of water from the pump assembly back to the water upon which the boat floats. A tiller control mechanism directs the flow of water from the open other end of the tube to control the direction of movement of the boat.

These, and other features of the invention, will be more fully understood by reference to the following drawings.

DETAILED DESCRIPTION OF THE PREFERRED EMBODIMENT

Figure 1:
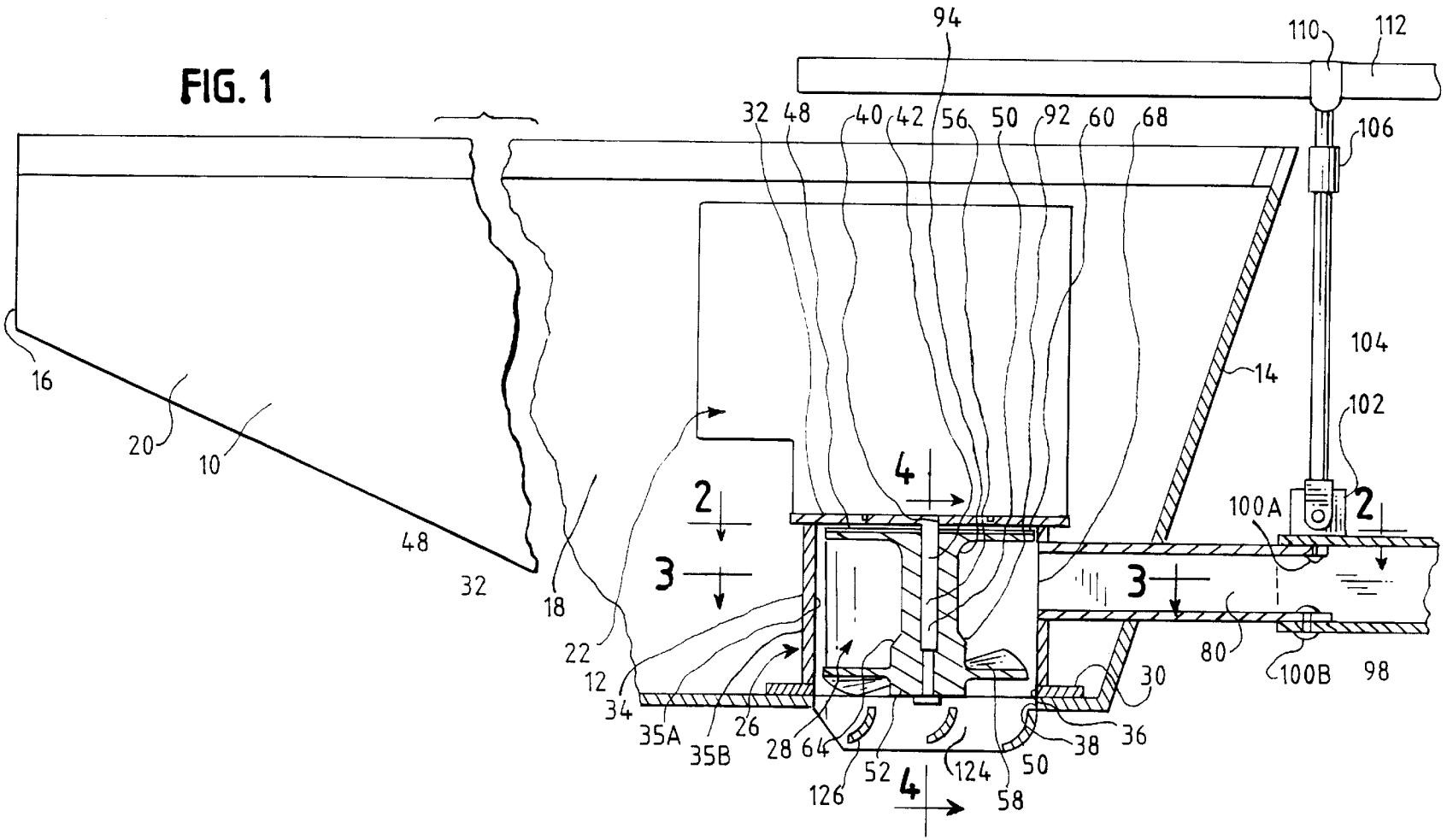
FIG. 1 is a side view of a boat and pump assembly constructed according to the present invention, a portion of the figure being broken away and in section along the central plane of symmetry of the pump.

FIG. 1 illustrates a boat 10 with a bottom 12, transom 14, bow 16 and sides 18 and 20. The bow 16 is generally square and the bottom 12 has as generally flat portion 21 extending from the transom 14 but terminating at a distance from the bow 16, in the manner of a Jon boat. The present invention may utilize any conventional boat construction, but it is desirable to use a boat with good low-speed planing characteristics, such as the Jon boat illustrated in FIG. 1.

A jet pump and engine assembly 22 is mounted on the upper side of the bottom 12 of the boat 10 adjacent to the transom 14. The assembly 22 has a conventional four-cycle air-cooled utility engine 24 mounted on a housing 26 of a pump 28. The housing 26 has a bottom plate 30 mounted on and sealed to the bottom 12 of the boat 10 and atop plate 32 disposed parallel to the bottom plate 30. The engine 24 is mounted on the top plate 32.

A hollow cylindrical sleeve 34 is mounted between the bottom plate 30 and top plate 32, and a circular opening 36 equal in diameter to the inner diameter of the cylindrical sleeve 34 extends through the bottom plate 30 coaxial with the cylindrical sleeve 34. A second circular opening 38 of a diameter equal to that of the opening 36 in the bottom plate 30 extends through the bottom 12 of the boat 10, thus forming a water intake for the pump 28.

The top plate 32 of the housing 26 has an aperture 40 coaxial with the cylindrical sleeve 34 and extending through the top plate. The engine 24 has a vertical drive shaft 42 that extends through the aperture 40 in the top plate of the housing 26, the drive shaft being coaxial with the cylindrical sleeve 34 of the housing 26. An impeller assembly 44 is mounted on the drive shaft 42 for rotation with the drive shaft within the cylindrical sleeve 34.

The impeller assembly 44 has an elongated axial channel 46 that extends therein from one end 48, and the axial channel 46 accommodates and is mounted on and secured to the drive shaft 42 of the engine 24. As illustrated in FIG. 1, the axial channel 46 of the impeller assembly 44 has an end portion 50 of smaller diameter that opens at the other end 52 of the impeller assembly, and a bolt 54 extends through the end portion 50 of the axial channel 46 and into a threaded bore 56 of the drive shaft 42 of the engine to secure the impeller assembly 44 on the drive shaft, but any conventional means could be employed for this purpose.

The impeller assembly 44 is an integral unit, and includes a first or axial flow impeller 58 disposed adjacent to the bottom plate 30, a second or centrifugal flow impeller 60 disposed adjacent to the top plate 32, and an elongated hub 62 extending between the first and second impellers. The hub 62 is cylindrical and coaxial with the engine drive shaft 42 and the cylindrical sleeve 34. The first impeller 58 is disposed within the sleeve 34 at the opening 36 in the bottom plate 30 of the housing 26, and has a cylindrical base 64 coaxial with the hub 62. A plurality of curved blades 66 are evenly distributed about the base 64 and extend outwardly from the base toward the inner surface 35A of the sleeve 34. Viewed from the engine 24 and as illustrated in the FIG. 2, the drive shaft 42 of the engine 24 rotates in a clockwise direction, and therefore the blades 66 are curved to propel water upwardly into the sleeve 34 with clockwise rotation. The ends of the blades 66 opposite the base 64 are disposed at a small distance from the inner surface 35A of the sleeve 34 to optimize the flow of water from the openings 36 and 38 into the end of the sleeve 34 and toward the second impeller 60.

Figure 2:
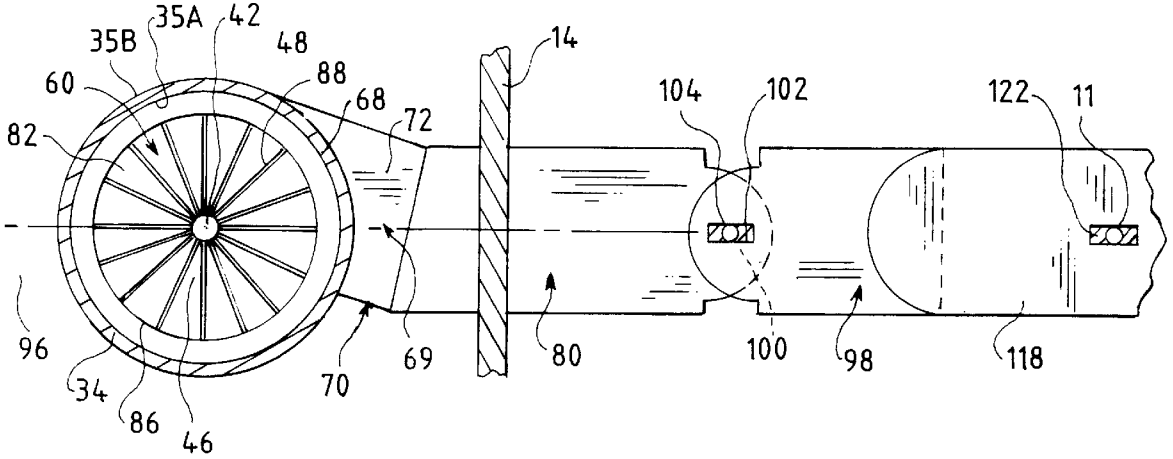
FIG. 2 is a sectional view of the boat and pump assembly taken along the line 2—2 of FIG. 1.
Figure 3:
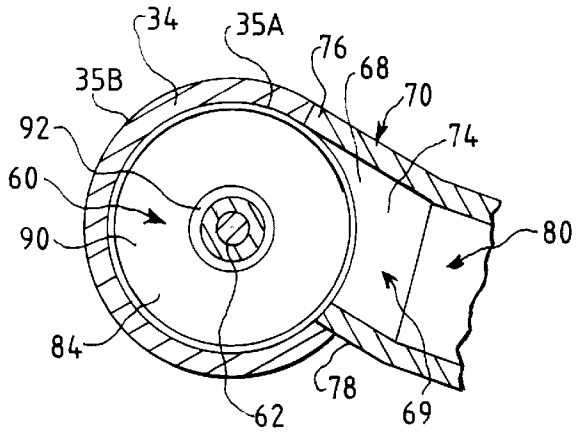
FIG. 3 s a sectional view of the boat and pump assembly taken along the line 3—3 of FIG. 1.

The sleeve 34 has a port 68 confronting the hub 62 between the first and second impellers 58 and 60. The port 68 is generally rectangular with major axes normal to the axis of the sleeve 34. As illustrated in FIGS. 2 and 3, a first part 69 of a hollow rectangular tube 70 is mounted on the sleeve 34 and sealed about the port 68. The first part of the tube 70 has a first pair of spaced parallel walls designated 72 and 74 that are perpendicular to the axis of the sleeve 34, and a second pair of spaced parallel walls 76 and 78 that are parallel to the axis of the sleeve. The inner surface of the wall 76 of the tube 70 is also tangential to the inner surface 35A of the sleeve 34, thereby providing a smooth transition for water flowing from the sleeve 34 into the tube 70. The tube 70 has a second part 80 that extends from the end of the first part 69, and the second part 80 of the tube 70 has a central axis which traverses the central axis of the sleeve 34. This construction optimizes the flow of water from the sleeve 34 through the tube 70.

The second or centrifugal flow impeller 60 is in the form of a flat disc, and has an upper surface 82 which is illustrated in FIG. 2, a lower surface 84 which is illustrated in FIG. 3, and a cylindrical perimetrical surface 86. The upper surface 82 has a plurality of equally spaced radial grooves 88 extending from the perimetrical surface 86 to the central channel 46, the grooves 88 serving the function of the veins of a conventional centrifugal pump at a reduced cost. The upper surface 82 confronts the top plate 32 and is spaced therefrom by a small distance to permit the centrifigal flow impeller to run in close proximity to the surface of the top plate 32. The grooves 88 are substantially square and of sufficient size to facilitate the flow of water outwardly along the grooves. In a preferred construction, the second impeller 60 is ¼ inch thick, the grooves are ⅛ inch square, and the perimetrical surface 86 of the second impeller has a diameter substantially the same as the diameter of the first impeller 58. In order to provide protection to the engine shaft seal and offset torque from the first impeller on the engine drive shaft, the second centrifugal flow impeller should have a diameter slightly smaller than the diameter of the sleeve and at least equal to one-third of the diameter of the sleeve. In this embodiment, the diameter if the inner surface 35A of the sleeve 34 is 5½ inches and the diameter of the perimetrical surface 86 of the second impeller 60 is 4⅞ inches, thereby leaving a gap of 5/16th inch between the cylindrical surface 86 of the second impeller 60 and the inner surface 35A of the sleeve 34. It is desirable to mount the second impeller 60 as close to the top plate 32 as possible, and the distance between the upper surface 82 of the second impeller and the top plate 32 should be no greater than 0.050 inch.

The lower surface 84 of the second impeller 60 has a flat portion 90 that extends from the perimetrical surface 86 of the impeller to a first truncated conical extension 92 disposed between the flat portion 90 and the hub 62. At the interface between the flat portion 90 and the first extension 92, the first extension has a diameter equal to the cylindrical base 64 of the first impeller 58. The conical surface of the first extension 92 forms an obtuse angle with the hub 62, and in the preferred construction, this angle is 135 degrees. Hence, the diameter of the hub 62 between the first and second impellers 58 and 60 is less than the diameter of the base 64 to facilitate flow of liquid through the port 68.

The cylindrical base 64 of the first impeller 58 has a second truncated conical extension 94 disposed between the hub 62 and the cylindrical base 64 of the first impeller 58. The diameter of the second extension 94 at the interface with the cylindrical base 64 is equal to the diameter of the base 64. The second extension 94 is a mirror image of the first extension 92, and forms an obtuse angle with the hub 62. In the preferred embodiment, this angle is 135 degrees. It is the function of the conical extensions 92 and 94 to provide smooth transitions from the first and second impellers 58 and 60 for the flow of water from the sleeve 34 into the port 68.

Figure 4:
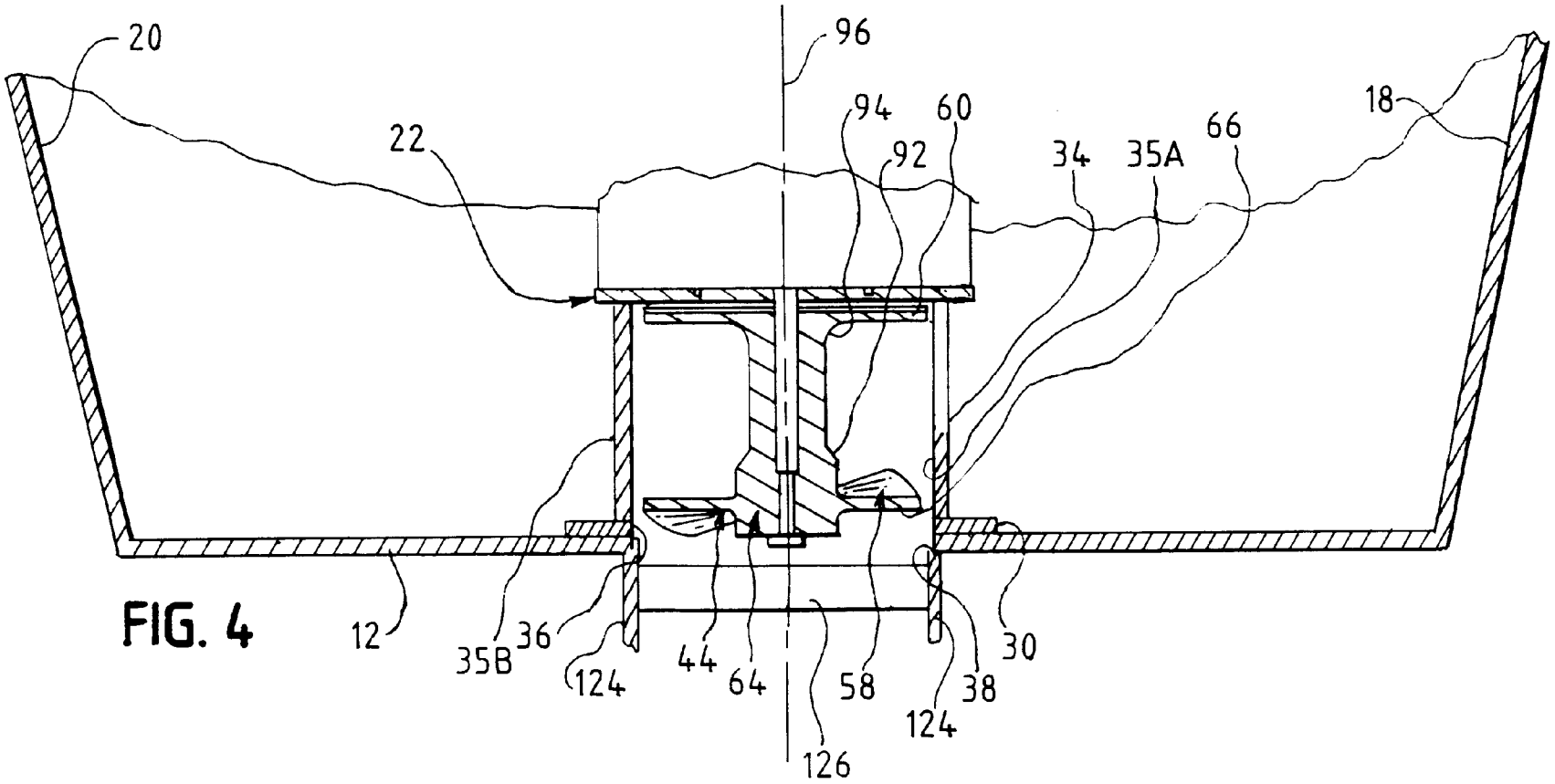
FIG. 4 is a sectional view of the boat and pump assembly taken along the line 4—4 of FIG. 1.

As illustrated in FIG. 4, the port 68 in the sleeve 34 extends from the top plate 32 downwardly to confront the interface between the cylindrical base 64 of the first impeller 58 and the first conical extension 92, and further extends through an angle with respect to the axis of the sleeve 34 of about 90 degrees. Hence, the port 68 confronts the region of the impeller assembly 44 between the first and second conical extensions 92 and 94, and hence the port is positioned to transport liquid from the first impeller 58. The second centrifugal flow impeller 60 does not contribute substantially to the flow of liquid into the port 68, but provides a dynamic and static seal between the engine drive shaft seal and the chamber formed between the first and second impellers 58 and 60, and offsets the axial thrust of the first axial flow impeller 58 on the drive shaft 42.

In the preferred construction, the opening 36 to the sleeve 34 has a diameter of 5½ inches, and the base 64 has a diameter of about 3.5 inches, thus providing an intake opening for liquid of about 14 square inches. The tube 70 has a cross section of 2¾ inches by 1¾ inches. Hence, the cross sectional area of the liquid intake is about three times the cross sectional area of the tube 70. Since water is incompressible, the flow rate through the tube 70 is about three times the flow rate through the opening 36. The engine 24 is a 16 horsepower air-cooled, four-cycle utility engine, and the diameter of the sleeve 34 has been selected to provide the proper load for this size engine.

As best illustrated in the FIGS. 2 and 3, the wall 76 of the discharge tube 70 of the pump 28 is tangential to the inner surface 35A of the sleeve 34. This construction captures the highest rotational velocity of the liquid and converts it into thrust. Further, water passing through the rectangular tube 70 has no spin. The second part 80 of the tube 70 extends through the transom 18 of the boat on the central plane 96 of the boat 10, and the discharged water from the tube 70 has no force vector tending to turn the boat 10. Thus, there is no need for stator blades to offset a turning force, which is common for most constructions and results in catching foreign materials and clogging.

The tube 70 also has a third part 98 that is pivotally attached to the end of the second part 80 by a pair of pins 100A and 100B. The pins 100A and 100B are disposed on a common axis normal to the longitudinal axis of the second part 80 of the tube 70 and parallel to the central plane 96 of the boat 10. A flange 102 is also mounted on the third part 98 of the tube 70 at the pin 100A, and the flange 102 extends upwardly from the tube 70 parallel to the axis of elongation of the third part 98 of the tube. A rod 104 is rotatably mounted on the transom 14 of the boat 10 by a bracket 106, and a linear tiller 108 is pivotally mounted by a pin 110 on the end of the rod 104 opposite the flange 102 and extends over the transom 14 of the boat for access by the boat operator. The tiller 108 is parallel to the third part 98 of the tube 70 and controls the direction of the boat.

The tiller 108 has an extension 112 extending rearward from the pin 110, and a second rod 114 is pivotally attached by a pin 116 to the end of the extension 112 opposite the pin 110. The second rod 114 extends downwardly, and a cap 118 is pivotally attached to the end of the second rod 114 by a pin 120. The cap 118 extends from the end of the third part 98 of the tube 70 opposite the second part 80, and the pin 120 is disposed on an axis normal to the axis of the sleeve 34, thereby permitting the cap 118 to be pivoted to confront the open end of the third portion of the tube 70 by raising the tiller 108. Raising the tiller 108 will thus divert the direction of the jet from the tube 70 to reduce the speed of the boat or reverse its direction of travel.

The pump 28 is provided with a protective scoop 122, which covers the opening 36 in the bottom plate 30. The scoop 122 has a pair of rails 124 disposed on opposite sides of the opening 36 parallel to the central plane 96 of the boat 10. A three spaced slats 126 extend between the rails 124, the slats being curved and facing the bow of the boat 10 to optimize the smooth flow of water into the openings 36 and 38. The slats also function to exclude large objects from the sleeve 34, thus protecting the impeller assembly 44.

Those skilled in the art will perceive may other uses and constructions for the inventions set forth in this disclosure. It is therefore intended that the scope of the present invention be not limited by this disclosure, but only by the appended claims.

The invention claimed is:

1. An engine and pump assembly comprising, in combination: a pump having a water impermeable housing with a hollow cylindrical sleeve open at one end, a plate mounted and sealed on the other end of the sleeve, said plate having an aperture disposed on the axis of the sleeve; an engine mounted on the housing having a drive shaft extending outwardly from the engine and through the aperture in the plate and into the housing, said shaft being disposed coaxially within the sleeve; and said sleeve having a port disposed therein; an elongated water impermeable hollow tube having a first end mounted and sealed on the sleeve and communicating with the port of the sleeve, said tube having an open opposing second end; a first impeller mounted on the shaft of the engine between the open end of the sleeve and the port for transporting water from the open end of the sleeve toward the plate of the housing; and a second impeller mounted on the shaft of the engine adjacent to the plate of the housing, said second impeller directing the flow of water away from the aperture in the plate.

2. A jet powered boat comprising the engine and pump assembly of claim 1 in combination with a boat having a bow, a transom opposite the bow, a bottom, and a pair of sides extending from the bottom between the transom and the bow, the engine and pump assembly being mounted on the bottom of the boat adjacent to the transom with the drive shaft of the engine disposed generally normal to the bottom of the boat, said boat having an opening in the bottom thereof confronting the open end of the sleeve to accommodate a flow of water into the sleeve, and an orifice in the transom, the tube extending through the orifice in the transom, and the second open end of the tube being disposed on the side of the transom opposite the sleeve.

3. A jet powered boat comprising the combination of claim 2 in combination with a protective cover disposed across the open end of the sleeve, the cover having a second plate mounted on the end of the sleeve opposite the first plate, the second plate having an opening confronting the opening in the sleeve, a pair of side rails mounted on the plate on opposite sides of the opening in the second plate, said rails being normal to the transom and extending outwardly from the second plate, and a plurality of spaced louvers mounted on the rails and extending between the rails.

4. A jet powered boat comprising the combination of claim 2 wherein the drive shaft of the engine is the crank shaft of an internal combustion engine.

5. A jet powered boat comprising the combination of claim 4 wherein the engine is a four-cycle air cooled engine with a vertical drive shaft.

6. A jet powered boat comprising the combination of claim 2 wherein the tube is disposed tangentially of the sleeve at the port in the sleeve and the boat has a central plane of symmetry extending from the bow through the transom, and wherein the engine and pump assembly is mounted in the boat with the port of the sleeve confronting one of the sides of the boat, the orifice in the transom being disposed on the central plane of the boat and the tube extending through the orifice in the transom on the central plane of symmetry.

7. An engine and pump assembly comprising the combination of claim 1 wherein the second impeller is a centrifugal flow impeller.

8. An engine and pump assembly comprising the combination of claim 1 wherein the first and second impellers are mounted on a common hub, the hub having an elongated cylindrical body and a channel disposed on the axis of the body, the drive shaft of the engine being disposed within the channel of the hub and secured to the hub, the first and second impellers being spaced from each other, and the port in the sleeve confronting the portion of the hub disposed between the first and second impellers.

9. An engine and pump assembly comprising the combination of claim 8 wherein the plate of the housing has a flat surface confronting the cylindrical sleeve and the second impeller comprises a disc having a flat surface disposed parallel to and adjacent to the plate of the housing, said flat surface having a plurality of grooves disposed therein, said grooves extending inwardly from the perimeter of the disc, the flat surface of the disc being spaced from the confronting surface of the plate by a distance sufficiently small to impede the flow of liquid inwardly between the disc and plate toward the drive shaft under operating conditions.

10. An engine and pump assembly comprising the combination of claim 9 wherein the flat surface of the disc of the second impeller is spaced from the confronting surface of the plate by a distance of not more than 0.050 inch.

11. An engine and pump assembly comprising the combination of claim 9 wherein the disc of the second impeller is circular and has a diameter shorter than the diameter of the sleeve and at least equal to one-third of the diameter of the sleeve.

12. An engine and pump assembly comprising the combination of claim 11 wherein the slots on the flat surface of the disc of the second impeller are linear and disposed on radii of the disc.

13. An engine and pump assembly comprising the combination of claim 8 wherein the hub has a first cylindrical portion coaxial with the channel therein, said cylindrical portion extending from the disc to a second cylindrical portion at the first impeller of larger diameter, the first impeller having a plurality of blades adapted to impel water into the region of the first cylindrical portion.

14. An engine and pump assembly comprising the combination of claim 13 wherein the hub has a first truncated conical portion extending between the first cylindrical portion and the disc and a second truncated conical portion extending between the first cylindrical portion and the second cylindrical portion.

* * * * *